US006843084B2

(12) United States Patent
Porter

(10) Patent No.: US 6,843,084 B2
(45) Date of Patent: Jan. 18, 2005

(54) STORAGE COMPARTMENT SECURITY SYSTEM

(76) Inventor: Dave Porter, 1011 W. Wade Hampton Blvd., Greer, SC (US) 29650

( * ) Notice: Subject to any disclaimer, the term of this patent is extended or adjusted under 35 U.S.C. 154(b) by 0 days.

(21) Appl. No.: 10/349,227

(22) Filed: Jan. 22, 2003

(65) Prior Publication Data

US 2003/0106356 A1 Jun. 12, 2003

Related U.S. Application Data

(63) Continuation-in-part of application No. 10/023,289, filed on Dec. 14, 2001, now Pat. No. 6,705,136.
(60) Provisional application No. 60/294,327, filed on May 30, 2001.

(51) Int. Cl.[7] ..... E05B 13/10
(52) U.S. Cl. ..... 70/208; 70/210; 70/224; 70/423; 70/427; 70/455; 292/336.3; 292/DIG. 31
(58) Field of Search ..... 70/208, 210, 215, 70/423–428, 455, 224, DIG. 31, DIG. 63; 292/336.3, DIG. 31

(56) References Cited

U.S. PATENT DOCUMENTS

| | | | | | |
|---|---|---|---|---|---|
| 279,334 | A | * | 6/1883 | Clark | 292/36 |
| 596,050 | A | * | 12/1897 | Byrnes | 292/36 |
| 932,330 | A | * | 8/1909 | Rotchford | 70/118 |
| 1,004,690 | A | * | 10/1911 | Russell | 70/134 |
| 2,131,033 | A | * | 9/1938 | Barrington et al. | 70/208 |
| 2,570,160 | A | * | 10/1951 | Schoch | 70/208 |
| 2,883,849 | A | * | 4/1959 | Wilson | 70/427 |
| 3,647,243 | A | | 3/1972 | Nagy et al. | 70/187 X |
| 3,812,403 | A | | 5/1974 | Gartner | 317/134 |
| 3,834,198 | A | * | 9/1974 | Wiczer | 70/208 |
| 3,933,382 | A | | 1/1976 | Counts et al. | 292/144 |
| 4,227,388 | A | * | 10/1980 | Nigrelli et al. | 70/427 |
| 4,688,492 | A | * | 8/1987 | Peghetti | 109/56 |
| 4,789,859 | A | * | 12/1988 | Clarkson et al. | 340/5.65 |
| 4,866,963 | A | | 9/1989 | Leininger et al. | 292/144 X |
| 5,010,754 | A | | 4/1991 | De Angelo et al. | 70/389 |
| 5,094,483 | A | * | 3/1992 | James | 292/39 |
| 5,351,512 | A | | 10/1994 | Pearlman | 70/257 |
| 5,404,736 | A | | 4/1995 | Lugo | 70/168 |
| 5,532,521 | A | | 7/1996 | Leininger | 307/10.2 |
| 5,603,328 | A | | 2/1997 | Zucker et al. | 128/664 |
| 5,609,051 | A | | 3/1997 | Donaldson | 70/303 A X |
| 5,760,703 | A | | 6/1998 | Becker | 340/825.69 |
| 5,806,355 | A | | 9/1998 | Lanigan et al. | 70/257 |
| 5,833,111 | A | | 11/1998 | Martineau | 220/6 |
| 5,893,282 | A | * | 4/1999 | Runge et al. | 70/208 |
| 5,984,383 | A | * | 11/1999 | Parikh et al. | 292/121 |

(List continued on next page.)

FOREIGN PATENT DOCUMENTS

| | | | | |
|---|---|---|---|---|
| CA | 789242 | * | 7/1968 | 70/208 |
| CH | 20760 | * | 1/1901 | 70/208 |
| GB | 1179411 | * | 1/1970 | 70/208 |

*Primary Examiner*—Lloyd A. Gall
(74) *Attorney, Agent, or Firm*—McNair Law Firm, P.A.

(57) ABSTRACT

A security system for a storage container including a latch assembly disposed on an interior side of a door for latching the door in a closed position with the storage container. A plurality of reciprocating latch elements are included in the latch assembly for latching the door in a closed position with the storage container. A latch actuator included in the latch assembly moves the latch elements to latch the door. A master lock assembly controls operation of the latch actuator by having a first locking part of the master lock assembly interlocking with a second locking part carried by an elongated shaft connected to an operator on the container exterior. A tamper-resistant control blocks access to the master lock assembly from outside the storage container whereby access to the container interior is prevented when the latch assembly is closed and the master lock assembly is in an engaged position.

12 Claims, 8 Drawing Sheets

U.S. PATENT DOCUMENTS 6,050,116 A 4/2000 Cole ..... 70/256
6,092,404 A * 7/2000 Chhatwal ..... 70/278.1
6,240,755 B1 * 6/2001 Da Silva ..... 70/423
6,298,699 B1 10/2001 Gartner et al. ..... 70/278.1
6,397,648 B1 * 6/2002 Morris et al. ..... 70/423
6,418,761 B1 * 7/2002 Wytcherley et al. ..... 70/208
6,474,119 B1 * 11/2002 Halvorson et al. ..... 70/208
6,705,136 B2 * 3/2004 Porter ..... 70/210

* cited by examiner

STORAGE COMPARTMENT SECURITY SYSTEM

This application is a continuation-in-part of application Ser. No. 10/023,289, filed Dec. 14, 2001 U.S. Pat. No. 6,705,136 which claims priority of Provisional Application Ser. No. 60/294,327, filed May 30, 2001.

FIELD OF THE INVENTION

The present invention relates to a security system for storage compartments, cargo containers, and the like. More particularly, the present invention relates to a latch assembly and master lock assembly mounted in the storage compartment interior for securing an access door of the storage compartment, wherein the interior latch assembly and master lock assembly may be operated by tamper-resistant controls on the compartment exterior.

BACKGROUND OF THE INVENTION

Every year, millions of dollars in equipment are stolen from construction sites. Often, a single piece of equipment costs thousands of dollars. In addition to the loss of equipment, the time taken to replace even the most inexpensive equipment can be great. Construction delays can result in thousands, if not millions of dollars in construction contract damages, lost revenue, and other costs.

At the construction site, storage containers are usually provided to store this equipment and used to deter theft thereby saving significant money and time. However, many of these containers have no, or only simple locking devices that have little effect against theft. Additionally, these devices can be defeated externally with little effort, are overly burdensome, unnecessarily complicated and do little to actually make the containers more secure.

For example, an external padlock can be easily defeated with bolt cutters. To compound the problem, a typical situation of individual insider theft occurs by one employed at a construction site who, for example, may be specifically skilled in metalworking. Such an individual has little trouble cutting through external locking systems.

Previous attempts to address the problem of theft from storage compartments using an internally mounted security system have only produced weak solutions that are easily defeated and provide a false sense of security. For example, U.S. Pat. Nos. 3,933,382 and 5,760,703 disclose security locks for the door of a cargo truck. The locks operate using a single electrically controlled bolt which locks with a wheel track of the door assembly, or in a bracket carried by the door. There is no other lock or latch assembly utilized to prevent the door from being unlocked. Overcoming a single lock is relatively straight forward and may easily be done to open the door.

U.S. Pat. No. 4,866,963 discloses a security system for locking doors on a cargo truck. The system employs a latch assembly carried on the exterior of the doors, but the latch assembly has no lock. Again, only a single bolt, as discussed above, on the interior side of the door is utilized to lock and secure the door. Because there is no cooperation between the exterior latch assembly and the internally mounted security bolt, only a single bolt secures one of the two large storage compartment doors, which can be easily defeated.

U.S. Pat. No. 6,298,699 shows a typical electronic combination lock for a residential or commercial entrance door having a dial-shaped handle with a keypad incorporated therein. When the correct combination is selected a deadbolt may be unlocked. This type of lock is not meant for use in the type of security system needed to control access to a large cargo container as its small size makes it easily defeatable given the size of the container doors.

Accordingly, an object of the present invention is to provide a security system mounted on the interior of a storage compartment which does not have externally mounted components that may be easily tampered with to gain access to the compartment interior.

Another object of the present invention is to provide a security system for a storage compartment which is cost efficient, easy to use, and requires multiple components to be manipulated in order to unlock the security system and open the door to the storage compartment.

Another object of the present invention is to provide a security system for a storage compartment that includes multiple internal securing points for locking the door, which are operated from a single internally mounted latch assembly controlled by a plurality of internally and externally mounted tamper-resistant controls that must be operated in a given order to successfully unlock the door.

SUMMARY OF THE INVENTION

The above objectives are accomplished according to the present invention by providing a security system for preventing unauthorized access to a storage container having an entryway for allowing access to a container interior and a door for closing the entryway and preventing access to the container interior, which includes a latch assembly carried by the door on an interior side of the door. The latch assembly has a closed position for latching the door to prevent access through the entryway to the storage container, and an open position in which the door may be opened to allow access through the entryway to the storage container.

At least one reciprocating latch element is included in the latch assembly for latching the door with the storage container when the latch assembly is in the closed position. A receiving member is carried by the storage container for receiving the latch element so that the latch element and receiving member latch the door closed. A latch actuator is included in the latch assembly for moving the latch assembly between closed and open positions.

An operator is disposed on an exterior side of the door outside the container for operating the latch assembly through the door. The operator connects with the latch actuator for operating the latch actuator on the interior side through the door, and thereby moving the latch assembly between opened and closed positions. In a particularly advantageous embodiment, the latch actuator is a rack and pinion mechanism carried by the door having a pinion meshing with a plurality of toothed racks. The operator engages and rotates the pinion which converts the rotary movement of the pinion to the linear movement of the racks in order to operate the latch assembly. The racks are connected to the latch elements so that when the pinion is rotated by the operator, the latch elements latch the door to the storage container receiving members.

A housing is disposed on the exterior side of the door having an operator slot for receiving and stowing the operator. The operator has a first position recessed within the operator slot for preventing movement of the latch assembly to the open position, and a second position extended out from the operator slot allowing movement of the latch assembly between the closed and open positions. Accordingly, access to the storage container interior is prevented when the operator is recessed within the housing and the latch assembly is in the closed position.

In the preferred embodiment, an operator lock assembly is carried on the exterior side of the door for interlocking with the operator. The operator lock assembly has a locked condition for locking the operator to the housing in the first position, and an unlocked condition for allowing the operator to extend to the second position and operate the latch assembly to open or close the door. Preferably, the operator includes an operating handle for manually manipulating the operator to move the latch assembly between the open and closed positions. In this embodiment, the operator lock assembly is carried by the handle for locking the handle to the housing in the operator slot when in the recessed first position.

Advantageously, an elongated shaft is connected to the operator that extends through the door for engaging with the latch assembly to move the latch assembly between closed and open positions. A master lock assembly is carried by the door on the interior side of the storage container for interlocking with the elongated shaft to control movement of the shaft by the operator. A removable master lock actuator is operable from the exterior side of the storage container through a keyhole in the door for moving the first locking part to position the master lock assembly between the engaged and disengaged positions.

A tamper-resistant control is carried on the exterior side of the door for controlling access to the master lock assembly through the keyhole. Preferably, the keyhole passes though the housing for the operator and then the door to allow insertion of the removable master lock actuator into the storage container interior to operate the master lock assembly. The tamper-resistant control is disposed within the housing to control insertion of the master lock actuator through the keyhole. The tamper-resistant control includes a deployed position in which the keyhole is blocked by the tamper-resistant control to prevent the removable master lock actuator from accessing the master lock assembly, and a retracted position wherein the keyhole is open and the removable master lock actuator may be inserted through the door to operate the master lock assembly.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
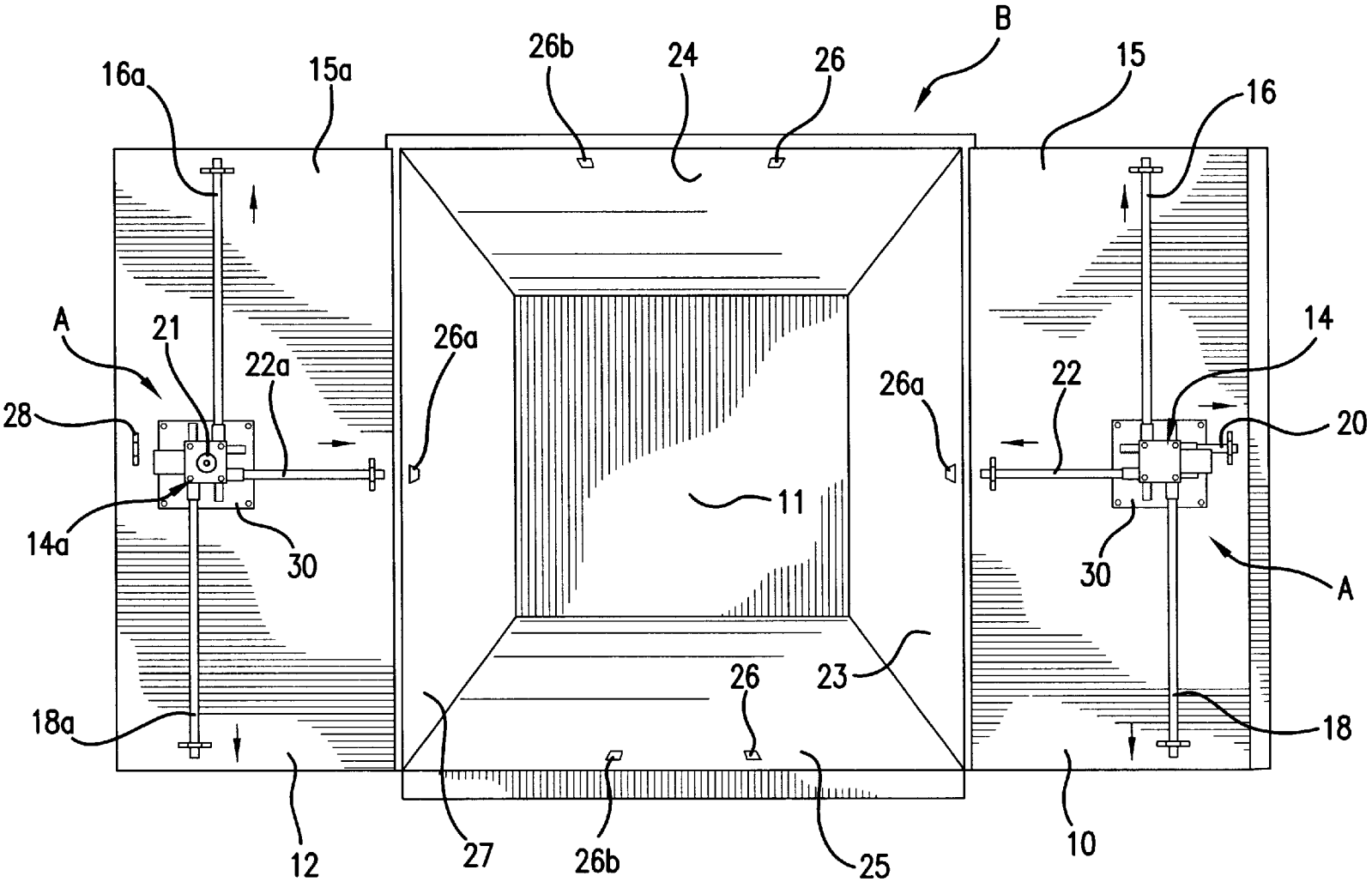
FIG. 1 shows an elevation view of the security system mounted to the interior side of a storage container door according to the invention.

Referring now to the drawings, the invention will be described in more detail. As best shown in FIG. 1, the present invention is an internally mounted security system, designated generally as A, used to secure doors closing an entryway for a storage compartment, designated generally as B. Typically the storage compartment is a large storage container of the type often found at construction sites, carried by semi-tractor trailers, and of the type generally used in the shipping industry. Generally, these storage containers have two large doors 10 and 12 which are located at one end of the container for closing the entryway and preventing access to the container interior 11. The major locking components of the security system used to secure the doors to the container are advantageously mounted on the interior sides of the doors within the storage container interior, when closed, in order to reduce tampering and unauthorized access to the contents of the storage container.

Referring to FIG. 1, the security system includes a latch assembly, designated generally as 14, carried on interior side 15 of first door 10 for latching the door closed to prevent access to the storage container interior. Because the latch assembly is disposed entirely within the container interior when door 10 is locked closed, there are no parts of the latch assembly on the outside of the storage container that may be tampered with to attempt to gain access the container interior. Latch assembly 14 has a closed position for latching door 10 to the contain in which the entryway for the container interior is closed off, and an open position wherein door 10 may be opened to provide access to the container interior.

In order to latch door 10 to the storage container in the closed position, latch assembly 14 includes reciprocating latch elements 16, 18, 20, and 22. Latch elements 16 and 18 are vertical reciprocating latch elements aligned to engage door header 24 and door footer 25 of storage container B when latch assembly 14 is in the closed position. Header and footer 24 and 25 preferably include receiving members 26 for receiving latch elements 16 and 18 to latch door 10 in the closed position. The receiving members can be formed from holes, with or without reinforcement, cut into the header and footer, having a sufficient diameter to receive latch elements 16 and 18. In the preferred embodiment, receiving members 26 are made from hardened metal sleeves flush mounted into the header and footer of the storage container doors, best shown in FIG. 1. In the preferred embodiment, the latch elements are formed from hardened metal rods resistant to bending, breaking, or cutting.

Latch element 20 and 22 are horizontally disposed reciprocating latch elements. Latch element 20 is aligned to engage second door 12 and secure both doors 10 and 12 together in a closed and locked position. Latch element 22 is aligned to engage receiving member 26*a* carried by sidewall 23 of the storage container. Preferably, a secondary latch assembly 14*a* is carried on interior side 15*a* of door 12 for latching the door in a closed position to prevent access to the storage container interior. When doors 10 and 12 are moved to close off the entryway and latch assembly 14 is moved to the closed position, latch element 20 is moved horizontally to interlock with door 12, preferably by engage a securing bracket 28 carried by door 12, which locks doors 10 and 12 together. In the preferred embodiment, secondary latch assembly 14*a* includes secondary reciprocating latch elements 16*a* and 18*a* vertically aligned to engage receiving members 26*b*. Secondary reciprocating latch element 22*a* is horizontally aligned to engage receiving member 26*a* carried by sidewall 27 of the storage container. In this construction and arrangement, second door 12 can be locked in the closed position together with first door 10 such that each side of the doors 10 and 12 is locked directly to the storage container of the adjacent door so that each latch element must be defeated before the door can be removed. In the preferred embodiment, secondary latch assembly 14*a* has no components operable from outside the storage container and may only be moved to the open position by rotating latch handle 21 from the interior of the container after latch assembly 14 has been unlocked and the door opened.

Figure 4:
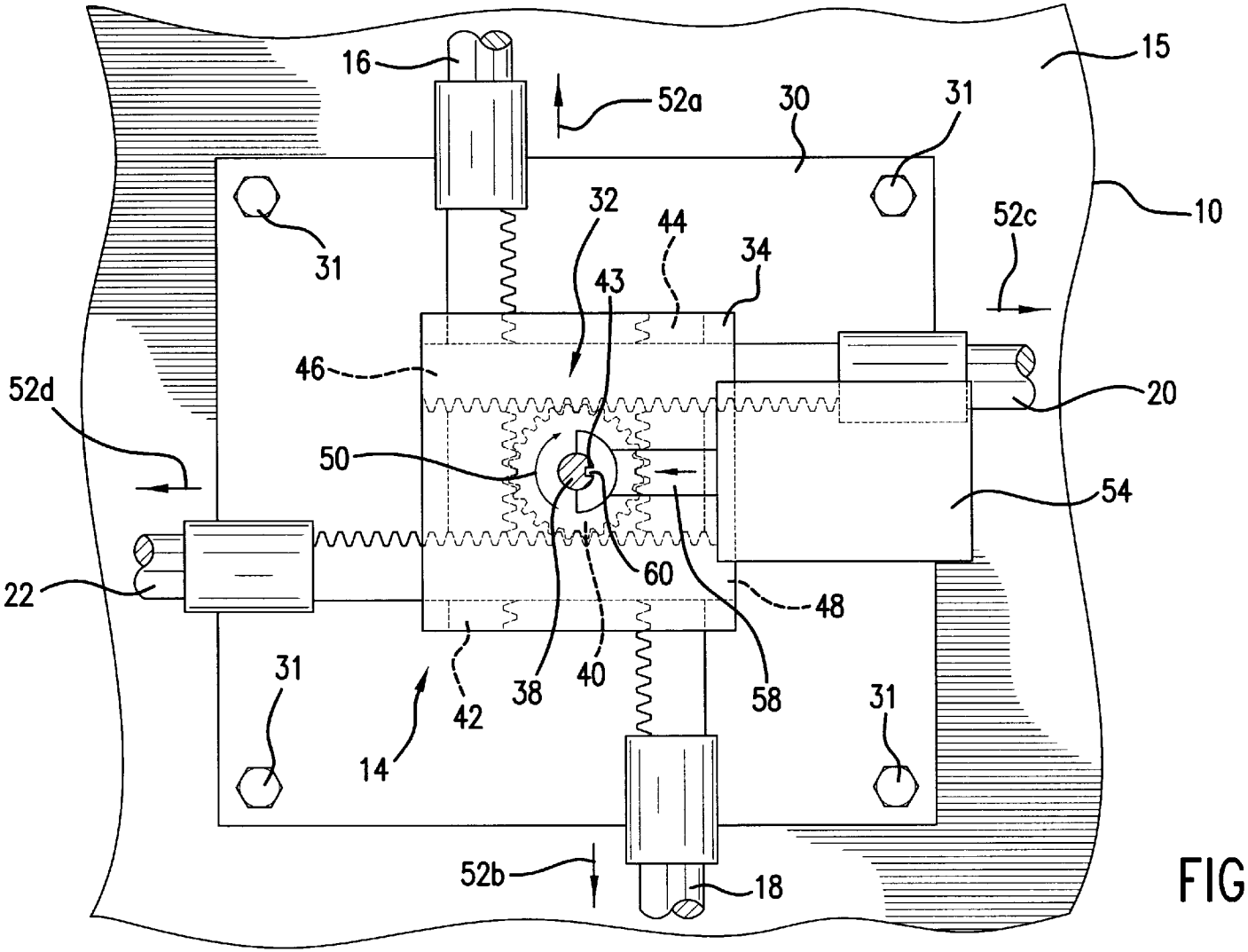
FIG. 4 shows an elevation view of the latch assembly and master lock assembly carried by the interior side of the storage container door in a closed and locked condition according to the invention.

Referring now to FIG. 4, latch assembly 14 is shown carried on interior side 15 of door 10 by mounting plate 30. Because many doors on storage containers do not have flat surfaces where the latch assembly can be mounted, mounting plate 30 can be anchored to the door to provide a flat surface for the latch assembly to be carried on the door. As well, the mounting plate provides a solid reinforcing barrier that must first be defeated before the latch assembly components can be tampered with. Bolts 31 are inserted through mounting plate 30 and into door 10. As the bolts are tightened into the door, mounting plate 30 is secured against door 10 and provides a solid reinforcing structure to the door that increases the tamper-resistance of the latch assembly and storage container door. Referring to FIG. 1, mounting plate 30 is also used to carry secondary latch assembly 14*a* on the interior side 15*a* of door 12.

Latch assembly 14 includes a latch actuator, designated generally as 32, disposed in latch housing 34 affixed to mounting plate 30. Latch actuator 32 is connected to latch elements 16, 18, 20 and 22 for reciprocating the latch elements to engage and disengage the storage container walls to position the latch assembly between open and closed positions. Latch actuator 32 is moved by rotating an operator 36 (FIG. 5) disposed an exterior side of door 10. Operator 36 includes, or is connected to, an elongated shaft 38 that engages the latch actuator through door 10 from outside the container to move the latch assembly between open and closed positions.

Figure 7:
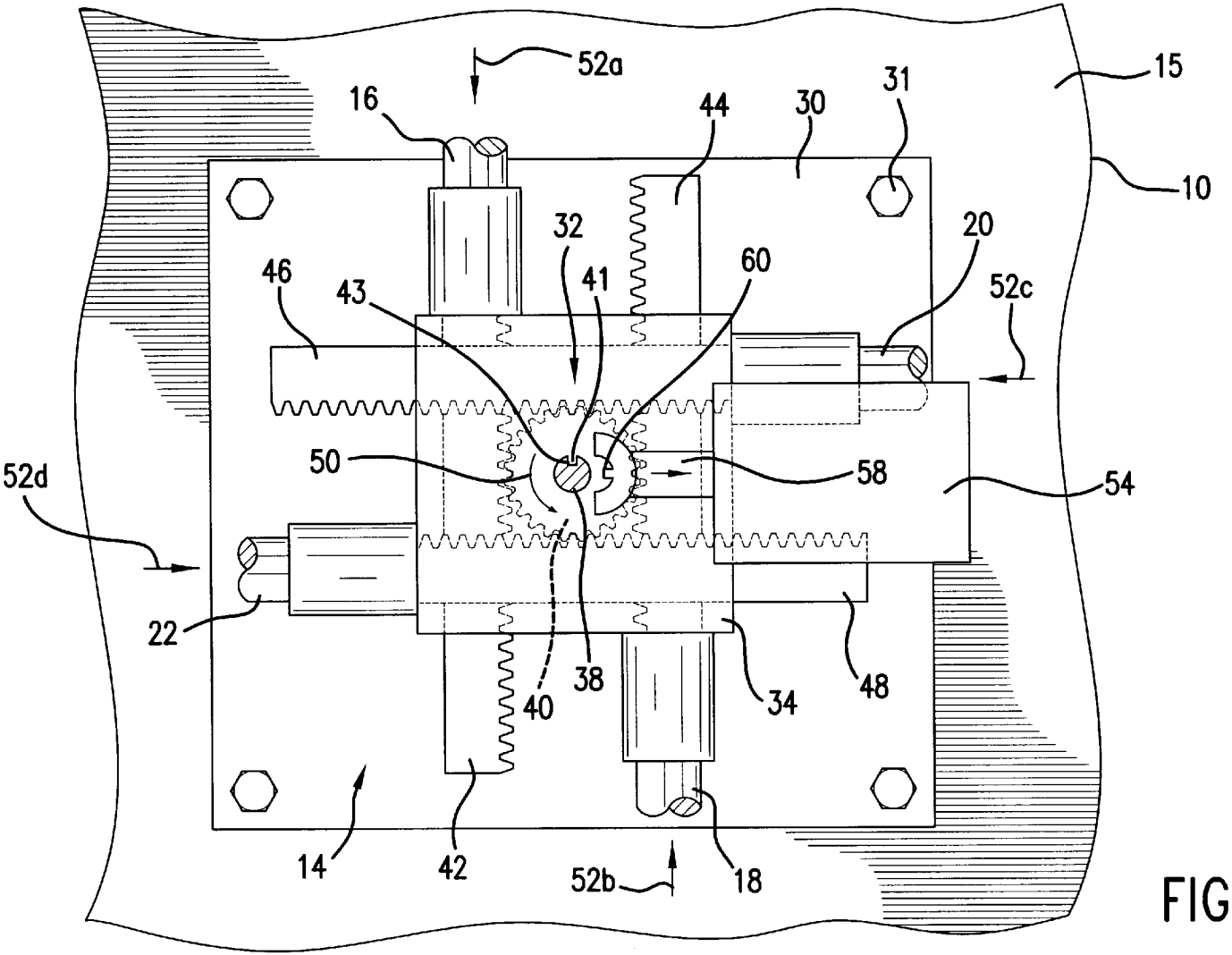
FIG. 7 shows an elevation view of the latch assembly and master lock assembly carried by the interior side of the storage container door in an open and unlocked condition according to the invention.

In the preferred embodiment, latch actuator 32 is formed using a rack and pinion mechanism where pinion 40 is engaged by elongated shaft 38. Referring to FIGS. 4 and 7, elongated shaft 38 includes a keyway 43 which receives key 41 carried by pinion 40. Toothed pinion 40 meshes with toothed racks 42, 44, 46, and 48 to complete the conversion of rotary movement of the pinion by the operator to linear movement of the racks to engage and disengaged the latch elements. The racks are connected to latch elements 16, 18, 20 and 22 to position the latch assembly between opened and closed positions with the storage container when the pinion is rotated. Latch housing 34 include channels 33 (FIG. 3) that hold racks 42, 44, 46, and 48, allowing them to slide through the housing. As shown in FIG. 4, as pinion 40 is rotated in direction 50 to move the latch elements, racks 42, 44, 46, and 48 are extended in directions 52*a*, 52*b*, 52*c* and 52*d* simultaneously to force latch elements 16, 18, 20 and 22 into receiving members 26 of storage container B and securing bracket 28 of door 12 to interlock with second door 12, respectively. As shown in FIG. 7, the rotation is reversed to disengage the latch elements from the storage container receiving members and securing bracket 28 of second door 12 to position the latch assembly in the open position.

Figure 3:
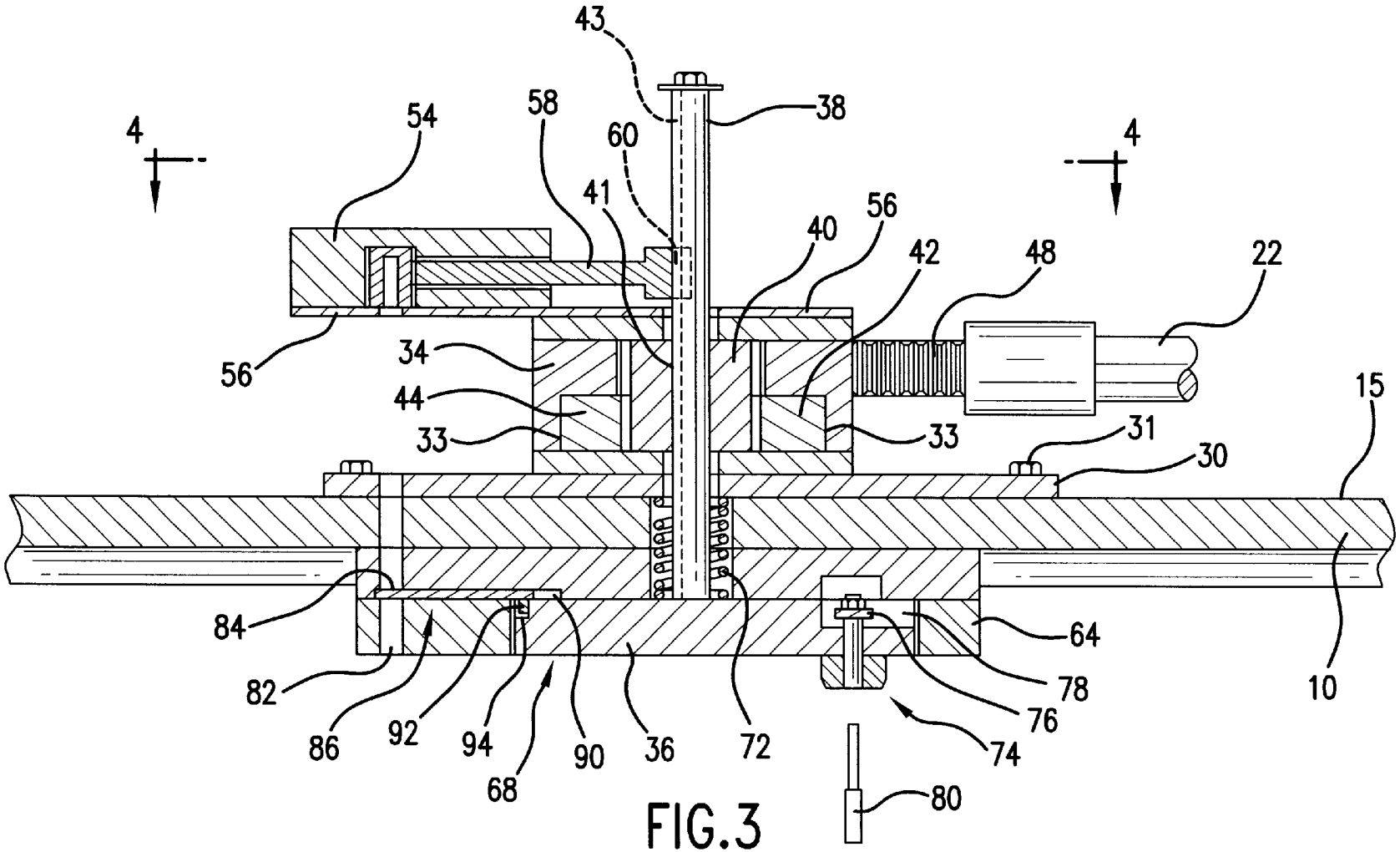
FIG. 3 shows a cross-section view of the security system in a closed and locked condition according to the invention.
Figure 5:
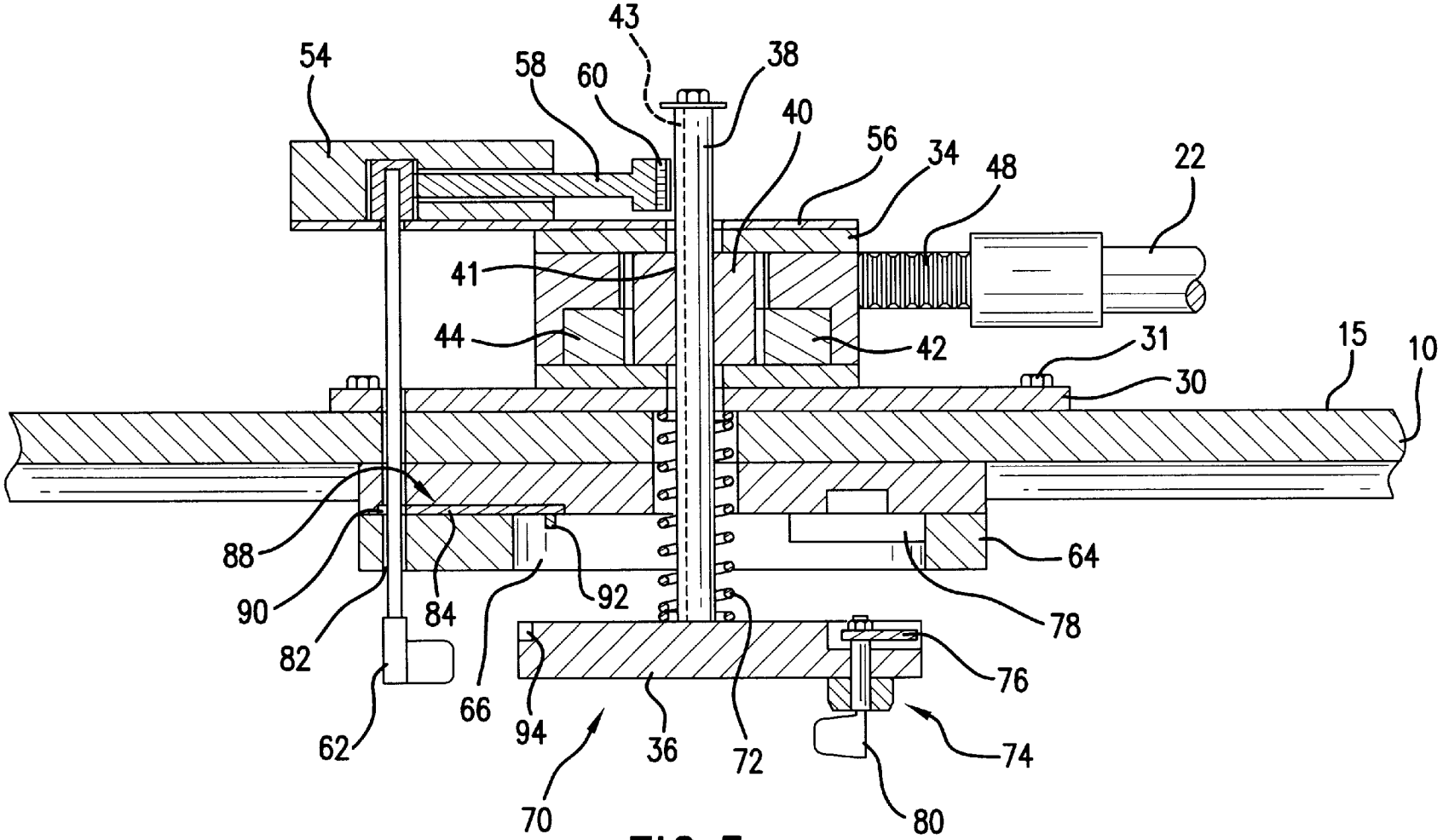
FIG. 5 shows a cross-section view of the security system in an unlocked condition according to the invention.
Figure 6:
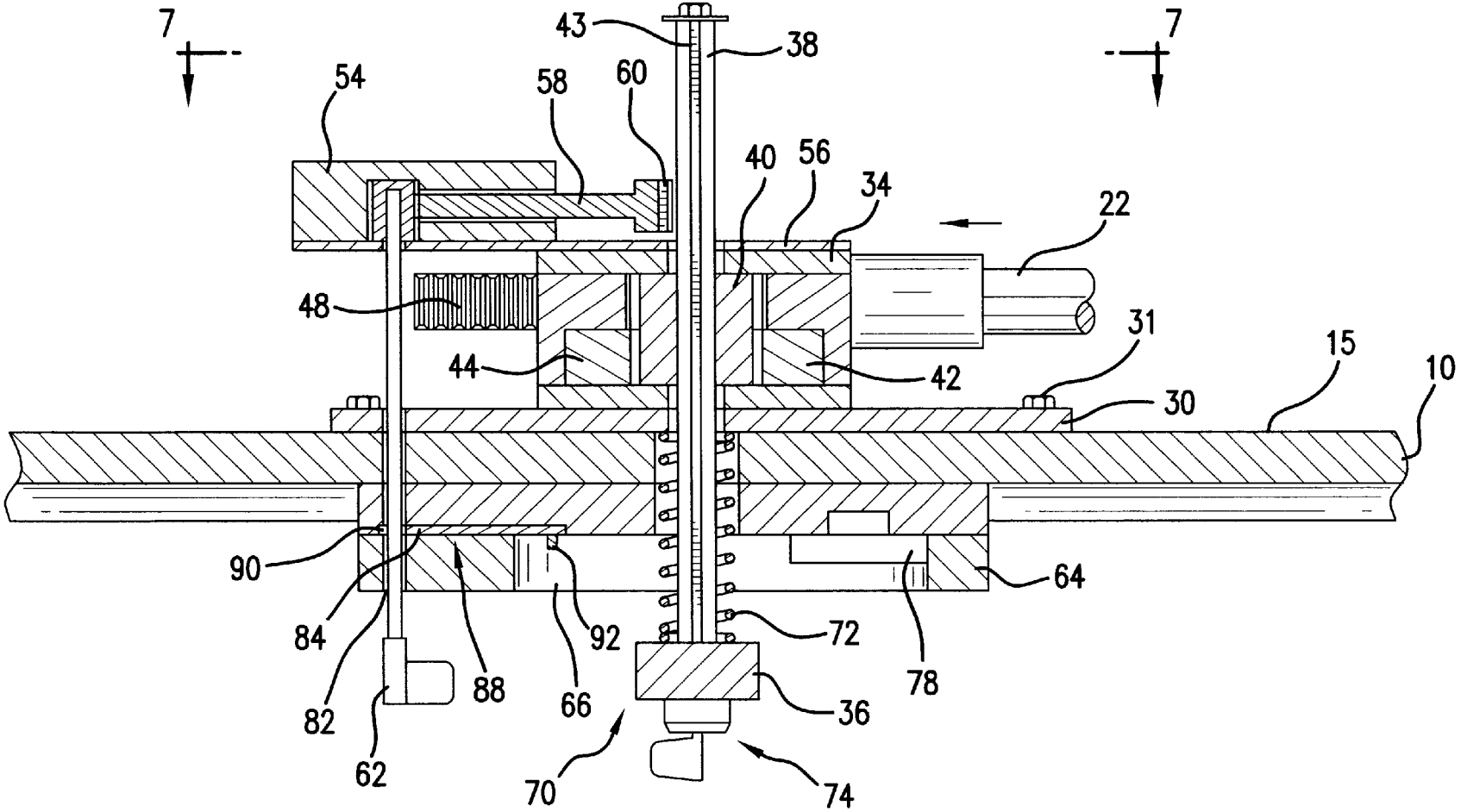
FIG. 6 shows a cross-section view of the security system in an open and unlocked condition according to the invention.

Referring now to FIG. 4, a master lock assembly 54 is operatively connected to elongated shaft 38 for controlling whether latch actuator 32, and ultimately the entire latch assembly 14, can be moved between closed and open positions. As shown in FIG. 4, the master lock assembly is capable of interlocking with the elongated shaft 38 to prevent rotation of pinion 40 by operator 36, as described herein below. As shown in FIG. 3, master lock assembly 54 is carried by master lock mounting plate 56, which is affixed to the outside of latch housing 34 on interior side 15 of container door 10. In this construction and arrangement the primary locking component of the security system is carried well within the interior of the storage container to prevent tampering. Referring to FIGS. 3 and 7, master lock assembly 54 includes a first locking part 58 that interlocks with a second locking part 43 carried by the portion of elongated shaft 38 which extends beyond latch housing 34. As shown in FIGS. 3 and 4, master lock assembly 54 has an engaged position wherein first locking part 58 is interlocked together with keyway 43 forms a part of the second locking part of the elongated shaft to prevent latch actuator 32 from moving latch assembly 14 between open and closed conditions. Referring to FIGS. 5, 6,and 7, master lock assembly 54 also has a disengaged position wherein first locking part 58 and second locking part 43 are unlocked to allow elongated shaft 38 to be rotated to in turn rotate pinion 40 to move the latch assembly and thereby extend or retract the latch elements as described above.

In the preferred embodiment, first locking part 58 is a hardened metal deadbolt having a key 60 which can be inserted into second locking part 43 of elongated shaft 38. Preferably, second locking part 43 is the same keyway of elongated shaft 38 that engages pinion 40. The keyway simply extends along the length of the elongated shaft into the portion extending beyond the latch housing. Additionally, various other means of interlocking first locking part 58 and second locking part 43 are well know to those skilled in the art and within the scope and spirit of the present invention. In the preferred embodiment, master lock assembly 54 is a mechanical lock capable of retracting first locking part 58 from second locking part 43 and then interlocking again. Mechanical locks are well-known in the art and only a description necessary to the understanding of the present invention is disclosed herein. A suitable mechanical lock which works well for purposed of the present invention is disclosed in U.S. Pat. No. 4,142,388.

Referring to FIGS. 5 and 6, as is described in further detail below, a removable master lock actuator 62 operable from the exterior side of the storage container door is provided for extending and retracting the first locking part to position the master lock assembly between engaged and disengaged positions with second locking part 43 of elongated shaft 38.

Figure 2:
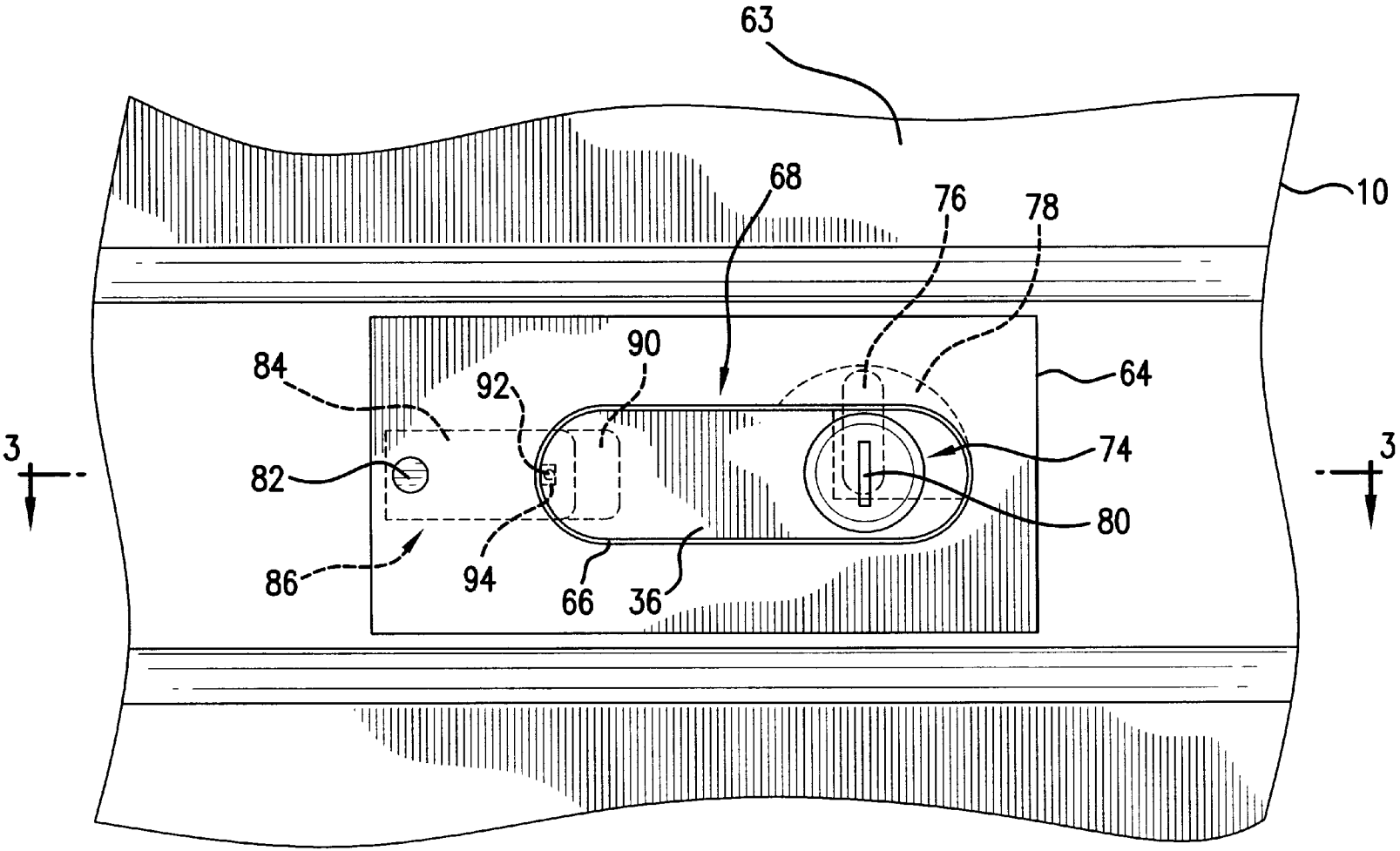
FIG. 2 is a front elevation view of a housing carrying an operator and tamper-resistant control on an exterior side of a storage container door according to the invention.

Moving to the exterior operating component of the security system, as shown in FIG. 2, operator 36 is disposed on exterior side 63 of door 10 outside the storage container for operating the latch assembly through the door. In the preferred embodiment, a housing 64 is disposed on the exterior side of the door. Referring to FIG. 5, housing 64 includes an operator slot 66 for receiving and stowing the operator when not in use to prevent tampering with and rotation of the operator. As shown in FIGS. 3 and 4, the operator has a first position, designated generally as 68, recessed within recess 66 for preventing use of the operator to move the latch assembly to the open position. Preferably, when in the first position, the operator is flush across the front of housing 64 when recessed in the operator slot, leaving nothing to tamper with on the doors exterior. Referring to FIGS. 5 and 6, the operator has a second position, designated generally as 70, extended out from the operator slot allowing the operator to be used to rotate pinion 40 and move the latch assembly between the closed and open positions, assuming master lock assembly 54 is in the disengaged position. As noted above, elongated shaft 38 is connected to the operator and extends through housing 64 and door 10 for engaging with latch actuator 32 to move the latch assembly between closed and open positions. A spring 72 is disposed around elongated shaft 38 between operator 36 and mounting plate 30 through door 10 to assist in moving the operator to the second extended position when unlocked. Other spring mechanisms may be used that would may not extend between mounting plate 30 and operator 36. These mechanisms are well known to a person skilled in the art and are included within the spirit and scope of the present invention. Thus, access to the storage container interior is prevented when the operator is recessed within housing 64 since the operator cannot be rotated to move latch actuator 32, and the latch assembly remains in the closed position.

An operator lock assembly, designated generally as 74, is carried on exterior side 63 of door 10 for locking the operator in the recessed first position within housing 64. The operator lock assembly has a locked condition for locking the operator in the first position, and an unlocke condition for allowing the operator to extend to the second position and operate the latch assembly to open or close the door. In the illustrated embodiments, operator 36 is shown as an oval shaped operating handle for manually manipulating the latch assembly between the open and closed positions when the operating handle is rotated. The operating handle is received in the corresponding oval shaped recess 66 as described above. The operator lock assembly is conveniently carried by the operating handle for locking the handle to housing 64 in the operator slot when in the first position.

Referring to FIGS. 2 and 5, to lock the handle in the operator slot, the operator lock assembly includes a main locking member 76 carried by the operator and a minor locking member 78 formed along an axial wall of recess 66 carried by housing 64. The main locking member interlocks with the minor locking member to provide the locked condition when the operator is recessed in the operator slot. The unlocked condition is provided when main locking member 76 is disengaged from minor locking member 78. Preferably, main locking member 76 is a reinforced metal arm that engages a slot formed in the wall of recess 66 that creates minor locking member 78. In one practical and durable embodiment, operator lock assembly 74 comprises a mechanical key operated locking mechanism commonly known in the art. In this arrangement, when operator 36 is recessed into operator slot 66, a key 80 is inserted into the operator lock assembly to rotate the reinforced metal arm that is the main locking member. The arm is then received into the recess in housing 64, which secures the operator to housing 64 in a locked recessed condition.

Figure 8:
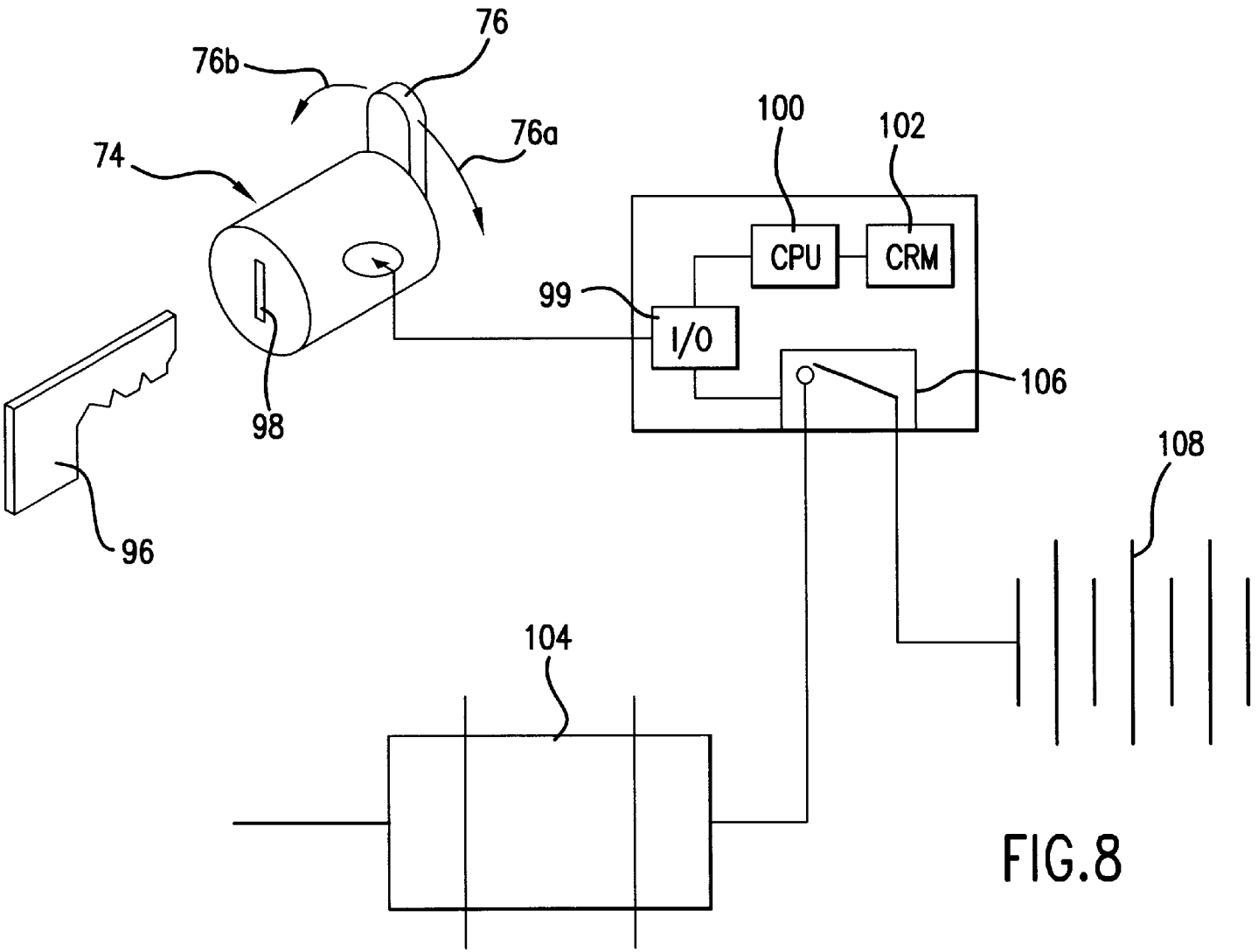
FIG. 8 shows a schematic of an electronic locking mechanism carried by the operator lock assembly according to the invention.

Referring to FIG. 8, in a particularly advantageous embodiment, operator lock assembly 74 comprises an electronic locking mechanism carried by the operator for rotating the main locking member to engage and disengage the minor locking member, as described above. Electronic locks are well-known to a person skilled in the art and only a description necessary to the understanding of the present invention is disclosed herein. In this embodiment, the mechanical key operated locking mechanism noted above is replaced by a more secure electronic locking system, which can only be activated to release the operator from its recessed position when the correct code is entered using a special electronically encoded key 96. To receive the electronically encoded key, the electronic locking mechanism includes a keyway 98. A microprocessor 100 is included in the electronic locking mechanism in electronic communication with keyway 98 through an input/output device 99 for reading and verifying, according to instructions from a computer readable medium 102 in electronic communication with microprocessor 100, an electronic code stored by electronically encoded key 96. The electronic locking mechanism moves the main locking member between the locked condition and the unlocked condition upon verification of the electronic code by the microprocessor when the electronically encoded key is inserted into the keyway. The electronic locking mechanism includes an electric motor 104, which is operatively associated with main locking member 76 to rotate the main locking member in directions 76*a* or 76*b* to engage and disengage with minor locking member 78. Upon verification of the correct electronic code from electronically encoded key 96, microprocessor 100 closes switch 106 to deliver power from power supply 108, included in the electronic locking mechanism, to electric motor 104 to move main locking member 76 between engaged and disengaged positions. In this manner, only the correct code will allow for the operator lock assembly to be set to the unlocked condition, allowing operator 36 to extend from operator slot 66 to the second position where it may be rotated to move the latch assembly to the open position.

Referring to FIGS. 3 and 5, as noted above, master lock assembly 54 is operatively associated with a removable master lock actuator 62 operable from outside the storage container through door 10 for moving first locking part 58 to the unlocked position. When latch assembly 14 is in the closed position with door 10 closed and master lock assembly positioned to the engaged position, access to the storage container interior is prevented. The removable master lock actuator must be inserted through door 10 from outside the container in order to unlock the master lock assembly and allow latch assembly 14 to be moved to the open position so that the door may be opened. In the preferred embodiment, removable master lock actuator 62 comprises an elongated key which is inserted through a keyhole 82, which passes through housing 64 and door 10, and is received by master lock assembly 54. Turning key 62 will then disengage master lock assembly 54 by retracting first locking part 58 from second locking part 43 carried by elongated shaft 38.

Advantageously, a tamper-resistant control 84 is carried by the door for controlling access to the master lock assembly through keyhole 82. The tamper-resistant control has a deployed position, designated generally as 86, shown in FIGS. 2 and 3, in which the keyhole is blocked to prevent removable master lock actuator 62 from being inserted through door 10 to access the master lock assembly, and a retracted position, designated generally as 88, shown in FIGS. 5 and 6, wherein the keyhole is open and the removable master lock actuator may be inserted through the door to engage and operate master lock assembly 54.

In the preferred embodiment, tamper-resistant control 84 comprises a slide-bolt disposed within a channel 90 including in housing 64 for allowing slide-bolt 84 to move between the deployed and retracted positions to block and open the keyhole, respectively. The tamper-resistant control includes a tab 92 extending into operator slot 66 for manually moving the slide-bolt between deployed position 86 and retracted position 88 when the operator is in the second position extending out of the operator slot. In deployed position 86, the slide-bolt extends perpendicularly through the keyhole to block the keyhole and prevent the removable master lock actuator from being inserted through the door, as well as, preventing tampering with the master lock assembly. The slide-bolt is slid into position by manually pushing tab 92. To prevent the slide-bolt from being backed out of the keyhole, tab 92 is received in operator recess 94 (FIG. 5) when the operator is in the first position recessed in housing 64. Tab 92 is then interlocked with the operator when recessed in the housing in the first position to lock the slide-bolt in the deployed position to block access to said master lock assembly, as shown in FIG. 3. Accordingly, only when operator 36 is unlocked and moved to the second extended position can tamper-resistant control 84 be moved to retracted position 88 so that removable master lock actuator 62 can be used to disengaged master lock assembly 54 from elongated shaft 38 so that the operator can be rotated to move the latch assembly to the open position.

While a preferred embodiment of the invention has been described using specific terms, such description is for illustrative purposes only, and it is to be understood that changes and variations may be made without departing from the spirit or scope of the following claims.

What is claimed is:

1. A security system for preventing unauthorized access to a storage container having an entryway for allowing access to a container interior, and a door for closing said entryway and preventing access to said container interior, said security system comprising:

a latch assembly carried by said door on an interior side of said door, said latch assembly having a closed position for latching said door to prevent access through said entryway to said storage container, and an open position in which said door may be opened to allow access through said entryway to said storage container;

an operator disposed on an exterior side of said door outside said container, said operator having an elongated shaft extending through said door for operating said latch assembly through said door;

a master lock assembly carried on the interior side of said door for interlocking with said elongated shaft to prevent movement of the latch assembly between said open and closed positions;

a removable master lock actuator operable from the exterior side of said storage container for operating said master lock assembly through a keyhole in said door;

a tamper-resistant control carried by said door for controlling access to said master lock assembly through said keyhole;

wherein said tamper-resistant control has a deployed position in which said keyhole is blocked by said tamper-resistant control to prevent said removable master lock actuator from accessing said master lock assembly through said door, and a retracted position wherein said keyhole is open and said removable master lock actuator may be inserted through said door to operate said master lock assembly; and, including a housing disposed on said exterior side of said door having a recess for receiving said operator; said keyhole for said master lock actuator passing through said housing and said door to provide access for operating said master lock assembly; and said tamper-resistant control comprising a slide-bolt, said slide bolt being mounted within said recess beneath said operator and movable between deployed and retracted positions to block and open said key hole.

2. A security system for preventing unauthorized access to a storage container having an entryway for allowing access to a container interior, and a door for closing said entryway and preventing access to said container interior, said security system comprising:

a latch assembly carried by said door on an interior side of said door, said latch assembly having a closed position for latching said door to prevent access through said entryway to said storage container, and an open position in which said door may be opened to allow access through said entryway to said storage container;

an operator disposed on an exterior side of said door outside said container having an elongated shaft extending through said door for operating said latch assembly through said door;

a master lock assembly carried by said door on the interior side of said storage container for interlocking with said elongated shaft to prevent movement of the latch assembly between said open and closed positions;

a removable master lock actuator operable from the exterior side of said storage container for operating said master lock assembly through a keyhole in said door;

a tamper-resistant control carried by said door for controlling access to said master lock assembly through said keyhole;

wherein said tamper-resistant control has a deployed position in which said keyhole is blocked by said tamper-resistant control to prevent said removable master lock actuator from accessing said master lock assembly through said door, and a retracted position wherein said keyhole is open and said removable master lock actuator may be inserted through said door to operate said master lock assembly;

including a housing disposed on said exterior side of said door having an operator slot for receiving said operator; said keyhole for said master lock actuator passing through said housing and said door to provide access for operating said master lock assembly; and said tamper-resistant control comprising a slide-bolt disposed within said housing for moving between said deployed and retracted positions to block and open said keyhole, respectively; and wherein said operator has a first position recessed within said operator slot for preventing operation of said tamper-resistant control, and a second position extended out from said operator slot allowing operation of said tamper-resistant control between said deployed and retracted positions.

3. The security system of claim 2 wherein said slide-bolt includes a tab for interlocking with said operator when recessed in said housing in said first position to lock said slide-bolt in said deployed position to block access to said master lock assembly.

4. A locking mechanism for a movable closure of a storage container comprising:

an operator including a shaft mounted on said closure, said operator being longitudinally movable between an inoperative first position and an operative second position;

a housing having a recess mounted on a first side of said closure, said recess being operative to receive and secure said operator against rotation when in said first position;

a lock assembly carried by said operator on said first side of said closure in axially spaced position relative to said shaft, said lock assembly being operable to selectively secure said operator within said recess and in said first position;

a removable lock assembly actuator for moving said lock assembly between a locked condition in engagement with said recess and an unlocked condition separated from said recess allowing longitudinal movement of said operator into said second and operative position;

a master lock having a locking part, carried on a second side of said closure and radially spaced from said operator shaft, said master lock having a locked condition in which said locking part engages with said shaft locking said shaft against rotation in both said first and second positions and an unlocked condition in which said locking part is radially spaced from said shaft freeing said shaft for rotation in said second position;

a removable master lock actuator for actuating said master lock to position said locking part in engagement with said shaft and spaced from said shaft; and a master lock passageway through said housing, said closure and into said master lock allowing insertion and removal of said master lock actuator.

5. The lock mechanism of claim 4, wherein one of said lock assembly and said master lock is an electronic locking mechanism controlled by an encoded actuator.

6. The lock mechanism of claim 4, including a slide bolt carried by said housing, said slide bolt being movable between a first position blocking said master lock passageway and a second position clear of said master lock passageway.

7. The lock assembly of claim 4, including a slide bolt mounted within said recess of said housing, said slide bolt being movable between a first position which permits movement of said operator into said first position within said recess and blocks said master lock passageway and a second position which prevents said operator from moving into said first position within said recess and uncovers said master lock passageway.

8. The lock mechanism of claim 4, including a latch actuator carried by said operator shaft and reciprocal latch elements carried by said closure, wherein rotation of said latch actuator causes reciprocal movement of said latch elements between a latched position or an unlatched position.

9. The lock mechanism of claim 4 wherein said master lock actuator is operative to move said locking part between engaged and disengaged positions with said shaft with said operator in either of said first and second positions.

10. A lock mechanism for a container having first and second doors for controlling access of said container:

an operator including an operator shaft mounted on and extending through said first door, said operator being mounted on a first side of said doors and being movable longitudinally between an inoperative first position and an extended operative second position, said operator and operator shaft, when rotated in said second position, controlling a plurality of longitudinally reciprocal latch elements carried by said first door between latched and unlatched positions;

a second operator mounted on an inner side of said second door, said second operator being rotatable between a first locking position and a second unlocked position, said second operator controlling a plurality of reciprocal second latch elements carried on said second door between latched and unlatched positions;

a housing mounted on an outer side of said first door, said housing including a recess for receiving the first operator in said first and inoperative position;

a lock assembly movable between a locked and unlocked condition carried by said operator in position axially spaced from said shaft, said lock assembly, in said locked condition, engaging with said recess locking said operator in said recess in said inoperative first position, said lock assembly in said unlocked condition, allowing axial movement of said operator into said second and operative position;

a master lock assembly mounted on an inner side of said first door in position radially spaced from said shaft, said master lock assembly having a locking part radially movable between a position spaced from said operator shaft and a position in engagement with said operator shaft, said locking part being operative to lock said operator shaft against rotation with said operator in said first and second positions; and a removable lock assembly actuator and a removable master lock assembly actuator for operating said lock assembly and said master lock assembly between locked and unlocked positions.

11. The lock mechanism of claim 10 including a master lock passageway through said housing and said first door for allowing passage of said master lock assembly actuator to and from said master lock; assembly and a slide bolt carried within said recess and movable between a blocking position closing said master lock passageway and a non-blocking position clearing said master lock passageway.

12. The lock mechanism of claim 10 including a slide bolt carried within said recess and movable between a blocking and a clear position, said operator when in said recess maintaining said bolt in said blocking position and said bolt in said clear position preventing movement of said operator into said recess.

* * * * *